United States Patent [19]

Dietrich

[11] 4,415,275

[45] Nov. 15, 1983

[54] SWIRL MIXING DEVICE

[76] Inventor: David E. Dietrich, 8450-101 Via Sonoma, La Jolla, Calif. 92037

[21] Appl. No.: 332,949

[22] Filed: Dec. 21, 1981

[51] Int. Cl.[3] ..... B01F 5/00; B01F 15/02

[52] U.S. Cl. ..... 366/165; 366/173; 366/183; 366/337; 366/340

[58] Field of Search ..... 261/79 A; 366/150, 165, 366/167, 173, 174, 177, 183, 290, 336, 337, 340, 338, 339

[56] References Cited

U.S. PATENT DOCUMENTS

| | | | |
|---|---|---|---|
| 3,238,021 | 3/1966 | Webber et al. | 261/79 A |
| 3,261,593 | 7/1966 | Sharples | 366/165 |
| 3,391,908 | 7/1968 | MacDonald | 366/177 X |
| 3,807,703 | 4/1974 | Day | 366/290 |
| 3,862,907 | 1/1975 | Shimotsuma et al. | 261/79 A X |

*Primary Examiner*—Robert W. Jenkins

*Assistant Examiner*—Arthur D. Dahlberg

*Attorney, Agent, or Firm*—John L. Haller

[57] ABSTRACT

A swirl mixing device adaptable as a spray nozzle or as a fluid mixing chamber for substantially complete mixing of two or more fluids is described. The device comprises a container having a closed end and an exhaust. At least two fluid injection chambers are defined within the container, the first of the chambers being located between the closed end and the second of the chambers. A first injector is arranged to inject a first fluid to be mixed into the first injection chamber with an angular momentum in one direction, and a second injector is arranged to inject a second fluid to be mixed into the second chamber with an angular momentum in the opposite direction to that of the first fluid. The fluids meet near an opening in a collar separating the two chambers, and an exit opening from the second chamber provides a fluid flow path to the exhaust.

24 Claims, 10 Drawing Figures

SWIRL MIXING DEVICE

BACKGROUND OF THE INVENTION

The present invention relates to a mixing device. More particularly, the invention relates to a mixing device for mixing fluids such as liquids, gases and fluid suspensions of particles, by the interaction of counter-rotating flows of fluids. This type of device is generally known as a swirl mixing device, the term "swirl" being generally used to refer to the circulating flow of the fluid in a mixing chamber.

Some prior art swirl mixing devices are known. Examples of such devices are shown in U.S. Pat. Nos. 981,098, 3,261,593 and 3,862,907. In these known devices fluids are directed into a cylindrical mixing chamber from inlet pipes having nearly tangetially directed outlets, such that the fluids tend initially to move around the outer wall of the chamber, and constrains (kinematically) eddies that must occur at the interface of the fluids to be mixed. This results in significant energy dissipation due to frictional losses as fluids impinge on the walls of the chamber. The fluids move more slowly as they approach the center of the chamber, resulting in a central "dead region". These effects reduce the ability of the fluids to mix thoroughly.

A swirl mixing device which reduces these effects is described in my earlier application, Ser. No. 205,147, where fluids are injected into a mixing chamber at spaced levels within the chamber, the fluids injected at different levels being injected in opposite rotational directions. The injection inlets are directed at a tangent to a circle of radius smaller than that of the mixing chamber, thus reducing the frictional energy losses due to interaction with the walls of the chamber.

SUMMARY OF THE INVENTION

The present invention provides a swirl mixing device which mixes fluids more efficiently.

The swirl mixing device according to the present invention basically comprises a container having an exhaust and at least two adjacent fluid injection chambers. Each injection chamber has injection means associated with it through which a respective fluid is injected into the chamber. The fluids are directed in opposite rotational directions in adjacent chambers. Passage means between the chambers allows the fluid in one chamber to flow into the next chamber and mix with the fluid there, and further passage means is provided between the final injection chamber and the exhaust.

The container preferably has a substantially cylindrical inner surface.

The injection means are preferably arranged to direct the fluids at a tangent to an imaginary circle of diameter less than that of the respective injection chamber and larger than a respective passage means. The fluids swirl in opposite directions within their respective chambers. As the fluid in the first chamber passes through the passage means, which preferably comprises a reduced diameter central circular opening in a collar separating the two chambers, the fluid will spin up (according to the so-called "figure skater effect") and thus there will be a relatively large tangential velocity in opposite directions where the two fluids meet. This results in radial gradients of swirl velocity which are fluid dynamically unstable, resulting in vigorous growth of small scale turbulent eddies. This greatly accelerates the mixing process, and the turbulence will be greater than that produced if both fluids are introduced into a single cylindrical mixing chamber.

Besides improving the efficiency of the device, the use of such collars leads to smooth performance over large ranges of injection pressure ratios and reduces the tendency to "chug", compared to other internal mix atomizers and mixers. Accordingly, the collar promotes smooth, efficient mixing/atomizing away from rigid boundaries.

Any number of fluids may be mixed by the addition of a further injection chamber for each additional fluid to be mixed. Each fluid is injected into its injection chamber with an angular momentum opposite to that of the fluid or fluids circulating in the preceding injection chamber. This is achieved by suitable selection of the injection axis and/or velocity.

The fluids are injected with a predetermined angular momentum such that the resultant angular momentum summed over all injected fluids is small compared to the angular momentum of an individual injected fluid. The mixture ejected from the exhaust therefore has low net angular momentum and tends to resist dispersion. This concentrates the exhaust and tends to produce a relatively high axial velocity near the center of the exhaust.

There may be a final mixing chamber between the injection chambers and the exhaust, or alternatively the exhaust may comprise an exit opening from the final injection chamber. The passage means comprise generally circular openings in walls separating the chambers, in a preferred embodiment, the openings being centered on the axis of the container. The openings are preferably of progressively increasing size towards the exit end of the container.

Each injector means is orientated to inject fluid into its associated chamber at such an angle that it tends to move initially in a circular path of radius less than that of the chamber and greater than that of the opening or passage into the next chamber.

The use of multiple symmetrically spaced injectors within a given a injection chamber promotes more uniform and efficient mixing/atomization, and such is within the scope of this invention.

The separating walls preferably comprise removably mounted collars, such that the size and shape of the injection chambers and the openings can be adjusted by the use of different shapes and sizes of collar. Thus the mixing device can be easily altered for the mixing of materials of various viscosities, for example.

Accordingly, in view of the above, it is an object of this invention to provide a swirl mixing device which enables thorough mixing of a plurality of reagents through the interactions of counter swirling flows. It is a further object of this invention to provide a swirl mixing device which can be used as a sprayer for atomizing a liquid with a gas and have the liquid dispersed in small uniform droplets with a full cone dispersion pattern.

It is another object of this invention to provide a swirl mixing device which is easy to fabricate and readily adaptable to a variety of materials and viscosities.

BRIEF DESCRIPTION OF THE ACCOMPANYING DRAWINGS

The following is a brief description of the accompanying drawings.

DESCRIPTION OF THE PREFERRED EMBODIMENT

Figure 1:
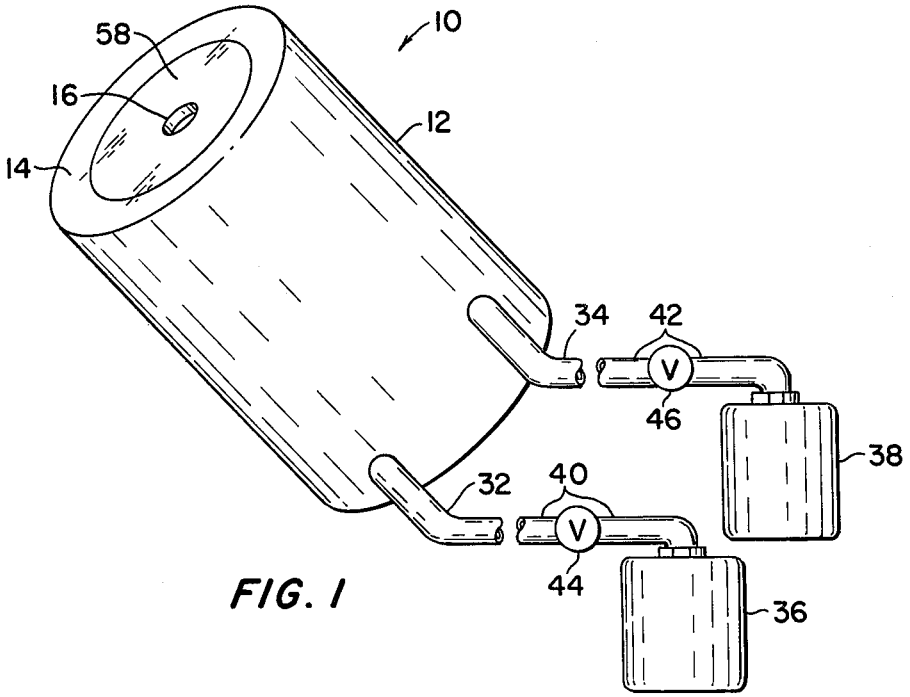
FIG. 1 is a perspective view of a swirl mixing device according to the present invention.
Figure 2:
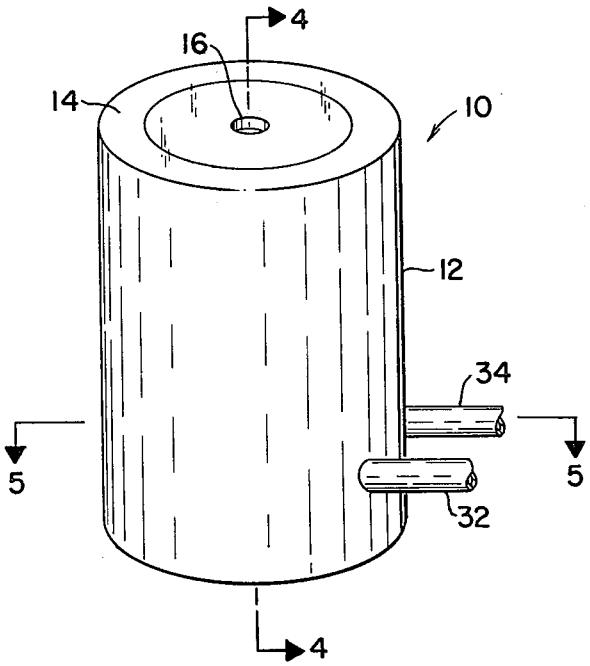
FIG. 2 is a front elevational view of the mixing device of FIG. 1.
Figure 3:
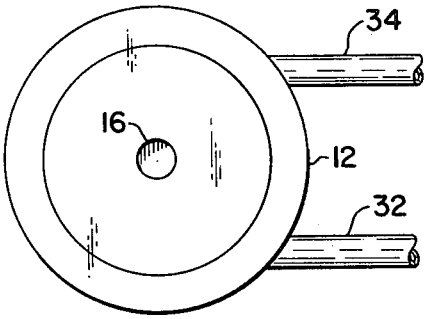
FIG. 3 is a top plan view of the mixing device of FIGS. 1 and 2.

FIGS. 1 to 5 show a first embodiment of a swirl mixing device 10 according to the present invention. The device comprises a cylindrically shaped container 12 closed at one end 14 and with an exhaust opening 16 at the opposite end.

Fluids to be mixed together in the container 10 are stored in conventional storage means, as shown by way of example at 36 and 38. The storage means 36 and 38 are connected to the respective fluid injection pipes 32 and 34 via piping 40, 42 and pressure control valves 44 and 46.

Figure 4:
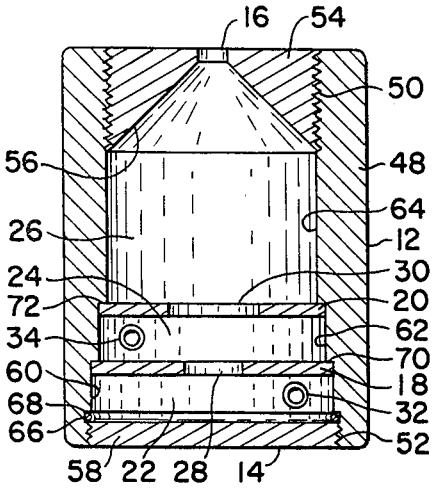
FIG. 4 is a vertical cross section along lines 4—4 of FIG. 3.

As shown in FIG. 4 the interior of the container is divided by separating collars 18 and 20 into a first fluid injection chamber 22, a second fluid injection chamber 24 and a final mixing chamber 26. Openings or passages 28 and 30 in collars 18 and 20, respectively, connect the first chamber 22 to the second chamber 24, and the second chamber 24 to the mixing chamber 26, respectively.

A first fluid injection pipe 32 communicates with the first injection chamber 22, and a second fluid injection pipe 34 communicates with the second injection chamber 24. The first and second fluid injection pipes 32 and 34 may include injection nozzels structured as the swirl mixing device 10 described in this application.

The body of the container is seen to comprise an open-ended sleeve 48 with screw-threaded portions 50 and 52 on its inner surface at each end. The threaded portion 50 at the exhaust end of the container is in threaded engagement with an exhaust head 54 in which exhaust opening 16 is located. The head 54 has a conical internal surface 56 leading to opening 16.

The threaded portion 52 at the bottom end of the container is in threaded engagement with a base plate 58.

The interior of sleeve 48 has three portions 60, 62 and 64 of progressively stepped diameter defining the respective chambers 22, 24 and 26. An O-ring seal 66 is compressed between a first step 68 and base plate 58 to prevent leakage from the bottom end of the container.

The collars 18 and 20 are removably mounted against steps 70 and 72, respectively.

This construction allows removal and replacement of the head 54, the base plate 58, and collars 18 and 20, for example to replace worn parts or to use parts of different shapes and sizes in order to modify the flow configurations within the chambers for different applications of the device. Thus, for example, an exhaust head with a different internal shape or different size exhaust opening could be used, to change the characteristics of the exhaust mixture. Collars with different shapes or different size openings could be substituted, for example to accommodate fluids of different viscosities. Although circular openings are preferred, slit or cross openings may also be used. The collar themselves need not be separate structures, but may be contoured portions of the inner surface of the sleeve.

It is therefore clear that this device has considerable versatility and some of the possible alternative configurations are described below in connection with other embodiments.

Figure 5:
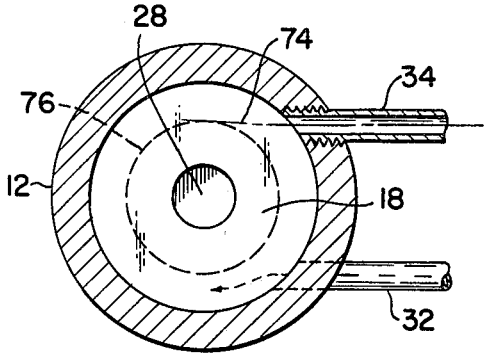
FIG. 5 is a horizontal cross section along lines 5—5 of FIG. 2.

Returning to the present embodiment, FIG. 5 shows the entry direction of injection pipe 34 into injection chamber 24. Injection pipes 32 and 34 are oriented so as to direct the injected fluids in opposite directions of swirl in their respective chambers 22 and 24. The injection axis 74 of pipe 34 lies on a tangent to an imaginary circle in a plane perpendicular to the container axis. The circle is of diameter less than that of chamber 24 but greater than that of opening 30 in collar 20. Fluid injected into this chamber will tend to move in a counterclockwise direction inwardly from this circle. Similarly, the injection axis of pipe 32 will be a tangent to a circle of diameter less than that of chamber 22 but greater than that of opening 28, and it will direct fluid entering the chamber in a clockwise direction. Opening 30 is larger than opening 28, and exhaust opening 16 is smaller than the openings between the chambers (see FIG. 4).

The counter swirling fluids will meet in the vicinity of opening 28 and thorough mixing will take place in chambers 24 and 26. The relatively large tangential velocities in opposite directions where the two fluids meet result in vigorous growth of small scale turbulent eddies. This is known as "centrifugal" or Taylor instability. It results in rapid mixing of the materials injected with opposing swirls, the reduced diameter opening where they meet enhancing the turbulent effect.

In this device relatively little pumping is required to achieve a given degree of mixing. When a mixing device according to the invention was used as a water spray nozzle, the nozzle was found to atomize 9 gallons per hour of water to a volume median diameter of 113 microns droplet size with only 2.5 psi air pressure at the rate of 1.7 standard cubic feet of air per minute. The nozzle was found to have a stable performance over a wide range of air to water injection pressure ratios.

The structure of the mixing of the present invention results in a high pressure region towards the outside of the chambers 24 and 26, caused by the fluid circulation. This high pressure causes a secondary flow of that fluid which has less swirl, i.e. angular momentum, towards the center of chambers 24 and 26. This effect is analagous to the "teacup effect" where tealeaves gravitate towards the center of the cup when the tea is stirred. Accordingly, that portion of the fluid which has low angular momentum and centrifugal acceleration is forced towards the center of chambers 24 and 26. Thus there is a selective movement of well-mixed (and hence low angular momentum) portions of the fluids towards the center of the chambers. Thus fluids entering chamber 26 through central opening 30 are relatively well mixed, and the same effect in mixing chamber 26 ensures even more thorough mixing prior to exhaust of fluids through opening 16.

The structure of this device substantially reduces or eliminates the centrifugal tendency of the fluids which are mixed and ejected from the container. Accordingly, the ejected mixture has relatively low dispersion characteristics and has a full cone exhaust pattern. "Full cone" exhaust means that the radial profile of the ejected mixture's axial velocity component has relatively high values near the center, as opposed to the low values occurring in rapidly swirling "hollow cone" exhaust patterns that occur when the angular momentum injection rates are not counter balanced.

The injection pipe 32 may be choked, for example by means of a nozzle or, alternatively, a flow restricting washer at the opening of the injection pipe 32 and 34 (not shown) to allow adjustment of the relative velocities, mass flow rates and angular momentum injection rates of the fluids. The injection axis is also adjustable whereby to adjust the angular momentum inparted to a fluid as it is injected into the chambers 24 and 26.

Figure 6:
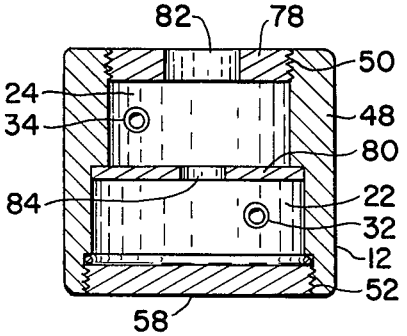
FIG. 6 is a vertical cross sectional view of a second embodiment of the mixing device according to the invention.

FIG. 6 shows a second embodiment of the swirl mixing device according to the invention. In this embodiment the cone shaped exhaust head 54 of the first embodiment, the cone shaped exhaust head 54 and the mixing chamber 26 and the upper portion 64 of the interior sleeve 48 have been removed leaving only a flat open exhaust head 78 and a single interior collar 80 to divide the container 12 into a first and second injection chamber 22 and 24. Thus the final mixing chamber is eliminated in this embodiment.

As in the first embodiment, fluids are introduced into the respective chambers via injection pipes 32 and 34 which are arranged to direct the fluids with opposing swirls. Mixing occurs in the second injection chamber 24 prior to exhaust through circular exhaust opening 32 in flat exhaust head 78. Opening 82 is of larger radius than that of opening 84 in collar 80.

Other parts of this embodiment are analagous to parts in the first embodiment and have been given like reference numerals. Parts 58, 78 and 80 are removable and can be replaced by parts of different shapes and sizes, as in the first embodiment.

Figure 7:
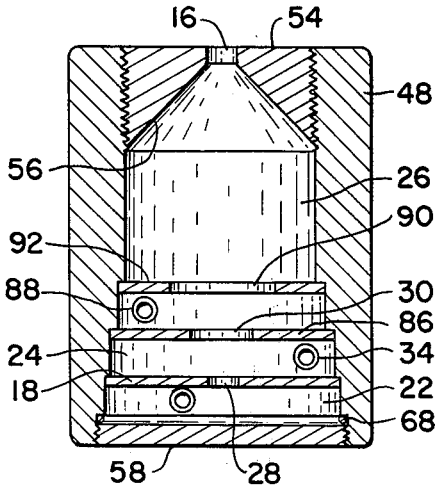
FIG. 7 is a vertical cross section through a third embodiment of mixing device in which three fluid injection chambers are provided.

FIG. 7 shows another embodiment of the mixing device in which a third fluid injection chamber 86 is provided between the first two injection chambers 22 and 24, and the final mixing chamber 26. A third fluid injection pipe 88 leads into chamber 86 from suitable fluid storage means (not shown). In the preferred embodiment, the injection pipes 32, 34 and 88 are of suitable relative orientations and/or sizes such that the fluid in each chamber tends to swirl in opposite direction to that of the fluid in the next adjacent chamber. However, within the scope of this invention adjacent injection pipes may inject fluids into adjacent chambers in the same direction provided that the net angular momentum of all injected fluids is small.

Thus, in the preferred embodiment, the fluids entering chambers 32 and 34 swirl in opposite directions, and when the mixture of fluid leaves chamber 34 it will swirl in a direction determined by the relative magnitudes of the angular momentum of the first two injection fluids. The fluid entering chamber 86 via injection pipe 88 is arranged to swirl in the opposite direction to that of the mixed fluids in chamber 34.

The angular momentum of each fluid is such that the resulting angular momentum summed over all injected fluids is small compared to the angular momentum of a single injected fluid.

Clearly any number of fluids can be mixed together in this way, by the addition of extra injection chambers and suitably arranged injection pipes.

The construction in FIG. 7 is otherwise analagous to that of the first embodiment, and like reference numerals have been used where appropriate.

The openings 28, 30 and 90 in collars 18, 20 and 92, respectively, which separate the chambers, are of progressively increasing radius towards the exhaust. The final mixing chamber may be eliminated as in the FIG. 6 embodiment so that the mixed fluids exhaust from the third injection chamber 86. The collars 18, 20 and 92 are removable as described in connection with the first embodiment.

Figure 8:
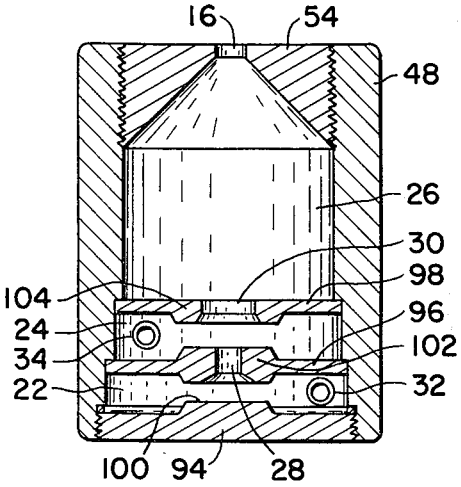
FIG. 8 is a vertical cross section through a fourth embodiment of the invention in which the chamber walls are contoured.

In FIG. 8 the use of a shaped end plate 94 and shaped collars 96 and 98 to change the shapes of chambers 22 and 24 is shown. Other parts in this embodiment are analagous to parts in the first embodiment and have been given corresponding reference numerals.

End plate 94 has a central projection boss 100 and the two collars 96 and 98 are thickened at 102 and 104, respectively, adjacent their central openings. Thus each injection chamber has a depth which decreases towards the central line. This tends to produce nearly axisymmetric flow of the fluids near the shallowest point in their respective chambers, if the injection pipe openings are relatively large as compared to the minimum depth areas of the injection chambers. This allows efficient and substantially axisymmetric mixing even if relatively large amounts of fluids are used.

If significantly less of one fluid than the other is to be used, its injection chamber can be of uniform depth while the other injection chamber is of reduced depth near its opening. This can be achieved by replacing collar 98 by a flat collar and by replacing collar 96 with a collar having a flat upper face, for example.

Figure 9:
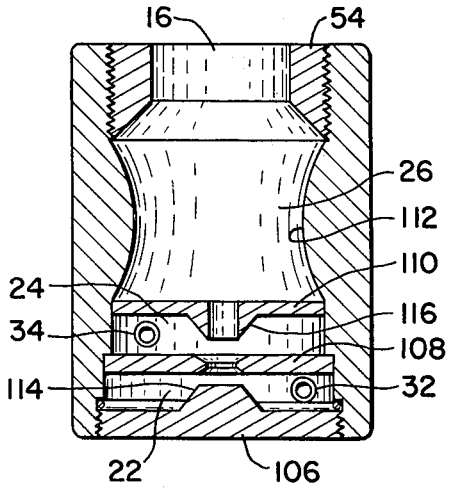
FIG. 9 is a vertical cross section through a further embodiment of the invention showing another type of contour to the chamber walls.

FIG. 9 shows another modified embodiment. A shaped end plate 106 and shaped collars 108 and 110 are again used, and a further modification is introduced in that the final mixing chamber 26 has an hourglass shaped inner contour having its narrowest point at 112. The hourglass contour is shown by way of example only as all surface contours are considered within the scope of this invention.

Because of the contoured mixing chamber shown in FIG. 9, the fluids will spin up at the narrowest point 112 (due to the so-called "figure skater effect") and this promotes more thorough mixing.

FIG. 9 also shows the exhaust opening 6 as wider than in previous embodiments. The exhaust opening is independent of other structural limitations shown in FIG. 9. Accordingly, all adjustments to the size of the exhaust opening are considered within the scope of the invention.

The shapes of plate 106 and collars 108 and 110 are such that opposed axial flow components are introduced to the fluid in chambers 22 and 24 as they are forced along conical surfaces 114 and 116, respectively. Accordingly, from the above, it can be seen that by structuring the contoured shapes of plate 106 and collars 108 and 110, a variety of axial components can be imparted to the fluid entering chambers 22 and 24. The adjustments of such contours are independent of other structural limitations of FIG. 9 and all variations thereof are considered within the scope of this invention.

Figure 10:
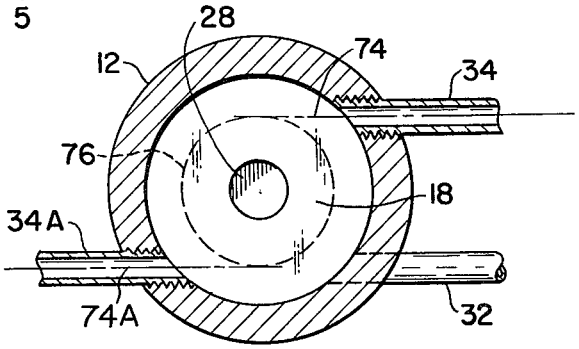
FIG. 10 is a horizontal cross section of through a further embodiment of the invention showing symmetrically spaced injectors within a given injection chamber.

FIG. 10 shows another modified embodiment of the fluid mixing device wherein the injection chamber 24 includes opposed injection pipes 34 and 34A. The opposed injection pipes 34 and 34A are structured to inject fluids into injection chamber 24 with the same angular momentum thereby promoting symmetrical injection of the injected fluid. Accordingly, it is within the scope of this invention to provide for multiple injection pipes within a given injection chamber.

The examples given above provide some indication of ways in which the various adjustable features of the mixing device can be changed to satisfy the requirements of various applications. These and other variations in the structure of the mixing device are within the scope of the invention.

Some examples of applications to which this mixing device can be adapted are: as a low pressure mixing vessel; as a vat for mixing fluidized reagents; as a combustion chamber; as a spray nozzle for producing an atomized spray of fluid droplets, e.g. for paint spraying, water spraying, insecticide sprays, and the like; or as a chemical reaction chamber.

The mixing device of this invention is designed to promote smooth efficient mixing and/or atomization and the selective exhaust of only well mixed and/or atomized materials. The mixing occurs in areas well spaced from the chamber walls, thus allowing more freedom for the turbulent eddies to mix the fluids. This also reduces the tendency for abrasive or reactive fluids to damage the chamber walls.

What is claimed is:

1. A device for mixing fluids comprising a container having a closed end and an exhaust; at least two fluid injection chambers within said container, a first one of said chambers being located between said closed end and the second one of said chambers; first passage means for fluid flow from said first to said second chamber; second passage means for fluid flow from said second chamber to said exhaust; first means for injecting a first fluid into said first injection chamber with a given angular momentum; and second means for injecting a second fluid into said second injection chamber with an angular momentum in the opposite direction to that of said first fluid.

2. The mixing device of claim 1, wherein said container is cylindrical; a first wall axially spaced from said closed end separates said chambers and has a central opening defining said first passage means; and a second wall axially spaced from said first wall defines said second chamber and has a central opening defining said second passage means.

3. The device of claim 2, wherein said walls comprise collars removably fixed within said container.

4. The device of claim 2, wherein said second opening is larger than said first opening.

5. The device as claimed in claim 1 above, wherein one or more further injection chambers are located between said second injection chamber and said exhaust, injecting means for injecting a selected fluid being associated with each further injection chamber, said first, second and further injection means being arranged to inject the respective fluids each with a preselected angular momentum such that the total angular momentum summed over all injected fluids is less than the injected angular momentum of any given injection fluid.

6. The device of claim 5, wherein spaced axial walls separate and define said first, second and further injection chambers, central openings in said walls defining passageways between said chambers and to said exhaust.

7. The device of claim 6, wherein said openings are of progressively increasing size towards said exhaust.

8. The device of claim 6, wherein said walls are removably fixed within said container.

9. The device as claimed in claim 5, wherein said exhaust comprises an exit opening from the final one of said injection chambers.

10. The device as claimed in claim 1 above, wherein a final mixing chamber is located between said injection chambers and said exhaust.

11. The device as claimed in claim 10, wherein said mixing chamber has contoured walls.

12. The device as claimed in claim 1 above, wherein said exhaust comprises an exit opening from said second injection chamber, said exit opening defining said second passage means.

13. The device as claimed in claim 1, wherein said injector means comprise injectors which are adjustably choked to change the velocity and mass flow of the injected fluids.

14. A mixing device comprising a cylindrical container having a closed end and an exhaust; a first collar securely fixed within said container, said collar having a central opening; a first fluid injection chamber defined between said closed end and said first collar; first means for injecting a first fluid into said first injection chamber in a direction tangential to a circle of radius greater than that of said opening but less than that of said chamber, and with a given angular momentum; a second collar securely fixed within said container between said first collar and said exhaust, said second collar having a central opening; a second fluid injection chamber defined between said first collar and said second collar; and second means for injecting a second fluid into said second chamber with an angular momentum opposite to that of said first fluid and in a direction tangential to a circle of radius greater than that of said opening in said second collar but less than that of said second chamber.

15. The device of claim 14, wherein said collars are removably fixed within said container.

16. The device of claim 15, wherein said closed end comprises a base plate removably fixed within the end of said container remote from said exhaust, such that said collars may be removed through said end after removal of said base plate.

17. The device of claim 14, wherein said collars comprise flat annular plates.

18. The device of claim 14, wherein said collars are shaped so as to define reduced axial length portions in said injection chambers adjacent their openings.

19. The device of claim 14, wherein said collars and said closed end are shaped so as to introduce an axial flow component to the fluids in said chambers.

20. The device of claim 19, wherein said first collar is flat with a tapered rim defining said first opening, said second collar has an inverted cone section adjacent its opening and pointing towards said first opening, and said closed end of said container has a raised truncated cone section facing towards said first opening.

21. The device as claimed in claim 14 above, wherein said exhaust opening is smaller than the smallest circle defined by the injected tangential direction of said fluids.

22. The device of claim 21, wherein an exhaust head is secured to said container at its exhaust end, said head having a conically shaped inner wall surface terminating in said exhaust opening.

23. A device for mixing fluids comprising a substantially cylindrical container having a closed end and an exhaust; at least two fluid injection chambers within said container, a first one of said chambers being located between said closed end and the second one of said chambers; first passage means for fluid flow from said first to said second chamber; second passage means for fluid flow from said second chamber to said exhaust; first means for injecting a first fluid into said first injection chamber in a direction tangential to a circle of radius greater than that of said first passage means but less than that of said first chamber, and with a given angular momentum; and second means for injecting a second fluid into said second injection chamber with an angular momentum in the opposite direction to that of said first fluid and in a direction tangential to a circle of radius greater than that of said second passage means but less than that of said second chamber.

24. A device for mixing fluids comprising:

a substantially cylindrical container having a closed end and an exhaust;

at least two fluid injection chambers within said container, a first one of said chambers being located between said closed end and the second one of said chamber;

first passage means for fluid flow from said first to said second chamber;

second passage means for fluid flow from said second chamber to said exhaust;

first means for injecting a first fluid into said first injection chamber in a direction tangential to a circle of radius smaller than that of said container, and with a given angular momentum; and second means for injecting a second fluid into said second injection chamber in a direction tangential to a circle of radius smaller than that of said container with an angular momentum in the opposite rotational direction to that of said first fluid.

* * * * *